US009458732B2

(12) United States Patent
McMahan et al.

(10) Patent No.: US 9,458,732 B2
(45) Date of Patent: Oct. 4, 2016

(54) TRANSITION DUCT ASSEMBLY WITH MODIFIED TRAILING EDGE IN TURBINE SYSTEM

(71) Applicant: General Electric Company, Schenectady, NY (US)

(72) Inventors: Kevin Weston McMahan, Greer, SC (US); Carl Gerard Schott, Simpsonville, SC (US); Clint Luigie Ingram, Simpsonville, SC (US); Gunnar Leif Siden, Greenville, SC (US); Sylvain Pierre, Greer, SC (US)

(73) Assignee: General Electric Company, Schenectady, NY (US)

( * ) Notice: Subject to any disclaimer, the term of this patent is extended or adjusted under 35 U.S.C. 154(b) by 351 days.

(21) Appl. No.: 14/063,358

(22) Filed: Oct. 25, 2013

(65) Prior Publication Data

US 2015/0114003 A1 Apr. 30, 2015

(51) Int. Cl.
*F01D 9/02* (2006.01)
*F01D 5/14* (2006.01)

(52) U.S. Cl.
CPC ..... *F01D 9/023* (2013.01); *F01D 5/141* (2013.01); *F05D 2240/122* (2013.01); *F05D 2250/182* (2013.01); *F05D 2250/183* (2013.01); *F05D 2250/71* (2013.01)

(58) Field of Classification Search
CPC ..... F01D 9/023; F01D 5/141
See application file for complete search history.

(56) References Cited

U.S. PATENT DOCUMENTS 2,702,454 A 2/1955 Brown
3,578,264 A 5/1971 Kuethe
3,776,363 A 12/1973 Kuethe
4,149,375 A 4/1979 Wynosky et al.
4,422,288 A 12/1983 Steber
4,741,667 A * 5/1988 Price ..... F01D 5/141 415/115
4,826,400 A 5/1989 Gregory
4,830,315 A 5/1989 Presz, Jr. et al.
5,077,967 A 1/1992 Widener et al.
5,110,560 A 5/1992 Presz, Jr. et al.
5,118,120 A 6/1992 Drerup et al.
5,149,250 A 9/1992 Plemmons et al.
5,249,920 A 10/1993 Shepherd et al.
5,414,999 A 5/1995 Barnes
5,457,954 A 10/1995 Boyd et al.
5,592,820 A 1/1997 Alary et al.
5,761,898 A 6/1998 Barnes et al.
5,839,283 A 11/1998 Döbbeling
5,934,687 A 8/1999 Bagepalli et al.
5,983,641 A 11/1999 Mandai et al.

(Continued)

*Primary Examiner* — Gerald L Sung
*Assistant Examiner* — Scott Walthour
(74) *Attorney, Agent, or Firm* — Dority & Manning, P.A.

(57) ABSTRACT

Transition duct assemblies for turbine systems and turbomachines are provided. In one embodiment, a transition duct assembly includes a plurality of transition ducts disposed in a generally annular array and comprising a first transition duct and a second transition duct. Each of the plurality of transition ducts includes an inlet, an outlet, and a passage extending between the inlet and the outlet and defining a longitudinal axis, a radial axis, and a tangential axis. The outlet of each transition duct is offset from the inlet along the longitudinal axis and the tangential axis. The transition duct assembly further includes an aerodynamic structure defined by the passages of the first transition duct and the second transition duct. The aerodynamic structure includes a pressure side, a suction side, and a trailing edge, the trailing edge having a modified aerodynamic contour.

9 Claims, 12 Drawing Sheets

(56) References Cited

U.S. PATENT DOCUMENTS

| | | | |
|---|---|---|---|
| 6,006,523 | A | 12/1999 | Mandai et al. |
| 6,076,835 | A | 6/2000 | Ress et al. |
| 6,202,420 | B1 | 3/2001 | Zarzalis et al. |
| 6,203,025 | B1 | 3/2001 | Hayton |
| 6,360,528 | B1 | 3/2002 | Brausch et al. |
| 6,431,555 | B1 | 8/2002 | Schroder et al. |
| 6,431,825 | B1 | 8/2002 | McLean |
| 6,442,946 | B1 | 9/2002 | Kraft et al. |
| 6,471,475 | B1 | 10/2002 | Sasu et al. |
| 6,537,023 | B1 | 3/2003 | Aksit et al. |
| 6,564,555 | B2 | 5/2003 | Rice et al. |
| 6,652,229 | B2 | 11/2003 | Lu |
| 6,662,567 | B1 | 12/2003 | Jorgensen |
| 6,840,048 | B2 | 1/2005 | Han et al. |
| 6,907,724 | B2 | 6/2005 | Edelman et al. |
| 7,007,480 | B2 | 3/2006 | Nguyen et al. |
| 7,024,863 | B2 | 4/2006 | Morenko |
| 7,159,383 | B2 | 1/2007 | Barton et al. |
| 7,181,914 | B2 | 2/2007 | Pidcock et al. |
| 7,533,534 | B2 | 5/2009 | Alkabie |
| 7,571,611 | B2 | 8/2009 | Johnson et al. |
| 7,584,620 | B2 | 9/2009 | Weaver et al. |
| 7,637,110 | B2 | 12/2009 | Czachor et al. |
| 7,721,547 | B2 | 5/2010 | Bancalari et al. |
| 7,966,826 | B2 | 6/2011 | Alkislar et al. |
| 8,065,881 | B2 | 11/2011 | Charron |
| 8,087,253 | B2 | 1/2012 | Ning et al. |
| 8,091,365 | B2 | 1/2012 | Charron |
| 8,113,003 | B2 | 2/2012 | Charron et al. |
| 8,231,084 | B2 | 7/2012 | Wright |
| 8,322,146 | B2 | 12/2012 | Rizkalla et al. |
| 2005/0172611 | A1* | 8/2005 | James Blodgett ..... B64D 33/06 60/262 |
| 2007/0017225 | A1* | 1/2007 | Bancalari ..... F01D 9/023 60/752 |
| 2009/0145132 | A1 | 6/2009 | Johnson et al. |
| 2010/0115953 | A1 | 5/2010 | Davis, Jr. et al. |
| 2010/0180605 | A1 | 7/2010 | Charron |
| 2010/0313567 | A1 | 12/2010 | Nakamura et al. |
| 2011/0179794 | A1 | 7/2011 | Tassios et al. |
| 2011/0259015 | A1 | 10/2011 | Johns et al. |
| 2011/0275966 | A1 | 11/2011 | Alkhattaf |
| 2012/0216542 | A1* | 8/2012 | Siden ..... F23R 3/46 60/772 |
| 2012/0304653 | A1 | 12/2012 | Flanagan et al. |
| 2012/0304665 | A1 | 12/2012 | Lebegue et al. |
| 2013/0094952 | A1 | 4/2013 | Stein et al. |

* cited by examiner

TRANSITION DUCT ASSEMBLY WITH MODIFIED TRAILING EDGE IN TURBINE SYSTEM

This invention was made with government support under contract number DE-FC26-05NT42643 awarded by the Department of Energy. The government has certain rights in the invention.

FIELD OF THE INVENTION

The subject matter disclosed herein relates generally to turbine systems, and more particularly to transition ducts of turbine systems.

BACKGROUND OF THE INVENTION

Turbine systems are widely utilized in fields such as power generation. For example, a conventional gas turbine system includes a compressor section, a combustor section, and at least one turbine section. The compressor section is configured to compress air as the air flows through the compressor section. The air is then flowed from the compressor section to the combustor section, where it is mixed with fuel and combusted, generating a hot gas flow. The hot gas flow is provided to the turbine section, which utilizes the hot gas flow by extracting energy from it to power the compressor, an electrical generator, and other various loads.

The combustor sections of turbine systems generally include tubes or ducts for flowing the combusted hot gas therethrough to the turbine section or sections. Recently, combustor sections have been introduced which include tubes or ducts that shift the flow of the hot gas. For example, ducts for combustor sections have been introduced that, while flowing the hot gas longitudinally therethrough, additionally shift the flow radially or tangentially such that the flow has various angular components. These designs have various advantages, including eliminating first stage nozzles from the turbine sections. The first stage nozzles were previously provided to shift the hot gas flow, and may not be required due to the design of these ducts. The elimination of first stage nozzles may eliminate associated pressure drops and increase the efficiency and power output of the turbine system.

However, the aerodynamic efficiency of currently known transition ducts is of increased concern. For example, recent studies have shown that hot gas flows through such transition ducts have relatively high aerodynamic losses, in particular relatively high pressure losses. Further, such studies have indicated the production of relatively high wakes in the downstream portions of the transition ducts, resulting in non-uniform flow and high unsteady mixing losses downstream thereof. Due to such non-uniform flow and unsteady mixing, first stage buckets in the turbine sections may be subjected to high cycle fatigue loads and thermal loads, which may significantly reduce the durability of the buckets.

Accordingly, an improved transition duct for use in a turbine system would be desired in the art. For example, a transition duct that provides increased efficiency values would be advantageous. Further, a transition duct which minimizes mixing losses, thus reducing overall pressure losses and increasing system performance and efficiency, would be advantageous. Still further, a transition duct which reduces high cycle fatigue loads and thermal loads on turbine section first stage buckets would be advantageous.

BRIEF DESCRIPTION OF THE INVENTION

Aspects and advantages of the invention will be set forth in part in the following description, or may be obvious from the description, or may be learned through practice of the invention.

In one embodiment, the present disclosure is directed to a transition duct assembly for a turbine system. The transition duct assembly includes a plurality of transition ducts disposed in a generally annular array and comprising a first transition duct and a second transition duct. Each of the plurality of transition ducts includes an inlet, an outlet, and a passage extending between the inlet and the outlet and defining a longitudinal axis, a radial axis, and a tangential axis. The outlet of each of the plurality of transition ducts is offset from the inlet along the longitudinal axis and the tangential axis. The transition duct assembly further includes an aerodynamic structure defined by the passages of the first transition duct and the second transition duct. The aerodynamic structure includes a pressure side, a suction side, and a trailing edge, the trailing edge having a modified aerodynamic contour.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
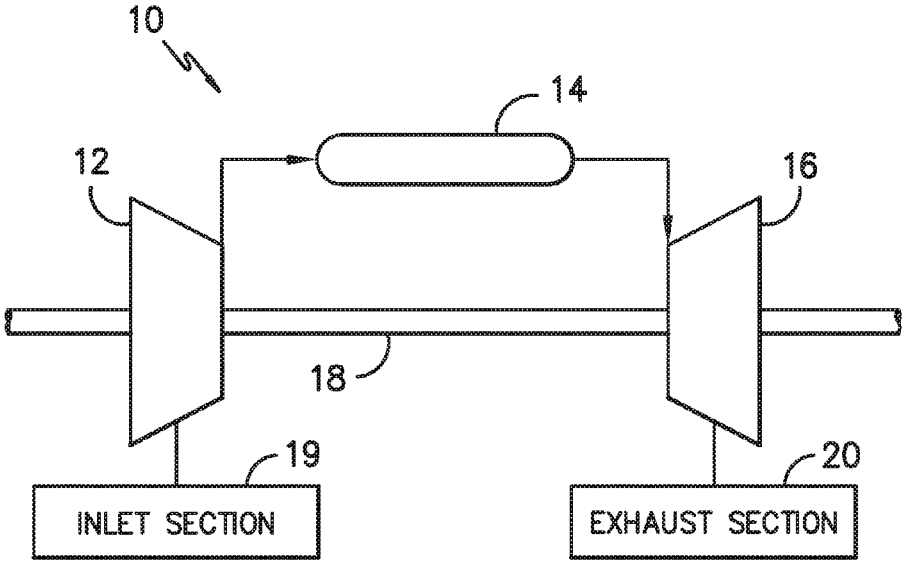
FIG. 1 is a schematic view of a gas turbine system according to one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a turbomachine, which in the embodiment shown is a gas turbine system 10. It should be understood that the turbomachine of the present disclosure need not be a gas turbine system 10, but rather may be any suitable turbine system or other turbomachine, such as a steam turbine system or other suitable system. The system 10 as shown may include a compressor section 12, a combustor section 14 which may include a plurality of combustors 15 as discussed below, and a turbine section 16. The compressor section 12 and turbine section 16 may be coupled by a shaft 18. The shaft 18 may be a single shaft or a plurality of shaft segments coupled together to form shaft 18. The shaft 18 may further be coupled to a generator or other suitable energy storage device, or may be connected directly to, for example, an electrical grid. An inlet section 19 may provide an air flow to the compressor section 12, and exhaust gases may be exhausted from the turbine section 16 through an exhaust section 20 and exhausted and/or utilized in the system 10 or other suitable system. Exhaust gases from the system 10 may for example be exhausted into the atmosphere, flowed to a steam turbine or other suitable system, or recycled through a heat recovery steam generator.

Figure 2:
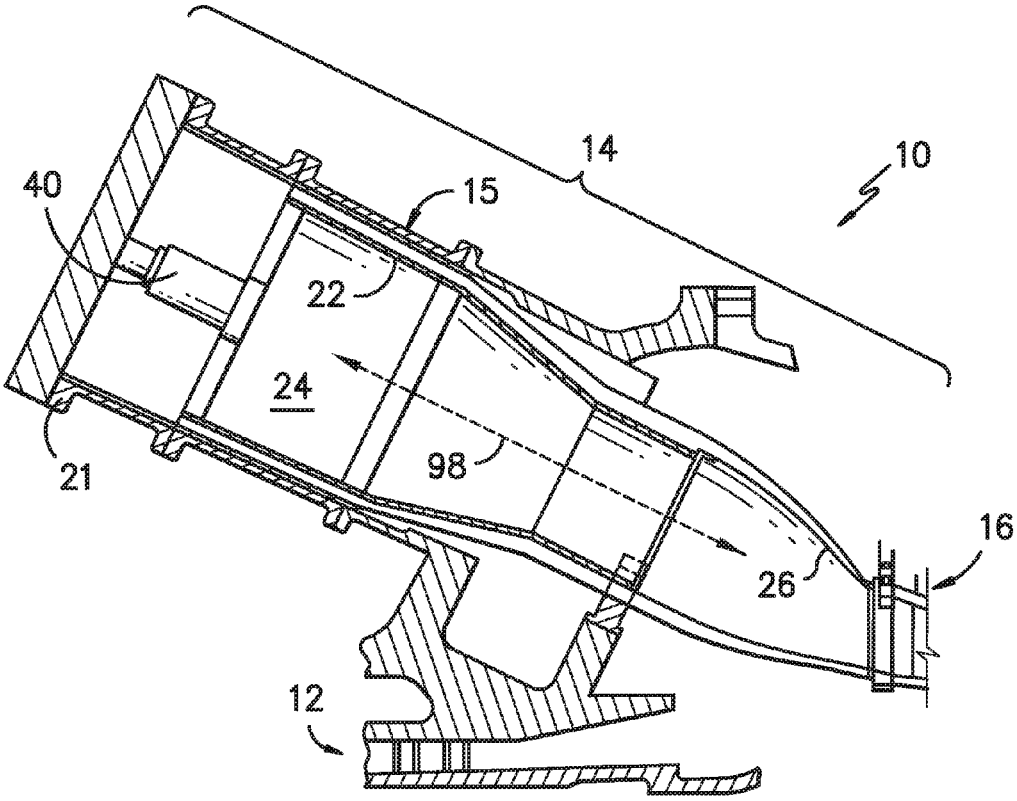
FIG. 2 is a cross-sectional view of several portions of a gas turbine system according to one embodiment of the present disclosure.

Referring to FIG. 2, a simplified drawing of several portions of a gas turbine system 10 is illustrated. The gas turbine system 10 as shown in FIG. 2 comprises a compressor section 12 for pressurizing a working fluid, discussed below, that is flowing through the system 10. Pressurized working fluid discharged from the compressor section 12 flows into a combustor section 14, which may include a plurality of combustors 15 (only one of which is illustrated in FIG. 2) disposed in an annular array about an axis of the system 10. The working fluid entering the combustor section 14 is mixed with fuel, such as natural gas or another suitable liquid or gas, and combusted. Hot gases of combustion flow from each combustor 15 to a turbine section 16 to drive the system 10 and generate power.

A combustor 15 in the gas turbine 10 may include a variety of components for mixing and combusting the working fluid and fuel. For example, the combustor 15 may include a casing 21, such as a compressor discharge casing 21. A variety of sleeves, which may be axially extending annular sleeves, may be at least partially disposed in the casing 21. The sleeves, as shown in FIG. 2, extend axially along a generally longitudinal axis 98, such that the inlet of a sleeve is axially aligned with the outlet. For example, a combustor liner 22 may generally define a combustion zone 24 therein. Combustion of the working fluid, fuel, and optional oxidizer may generally occur in the combustion zone 24. The resulting hot gases of combustion may flow generally axially along the longitudinal axis 98 downstream through the combustion liner 22 into a transition piece 26, and then flow generally axially along the longitudinal axis 98 through the transition piece 26 and into the turbine section 16.

The combustor 15 may further include a fuel nozzle 40 or a plurality of fuel nozzles 40. Fuel may be supplied to the fuel nozzles 40 by one or more manifolds (not shown). As discussed below, the fuel nozzle 40 or fuel nozzles 40 may supply the fuel and, optionally, working fluid to the combustion zone 24 for combustion.

Referring now to FIGS. 3 through 15, a combustor 15 according to the present disclosure may include one or more transition ducts 50, generally referred to as a transition duct assembly. The transition ducts 50 of the present disclosure may be provided in place of various axially extending sleeves of other combustors. For example, a transition duct 50 may replace the axially extending transition piece 26 and, optionally, the combustor liner 22 of a combustor 15. Thus, the transition duct may extend from the fuel nozzles 40, or from the combustor liner 22. As discussed herein, the transition duct 50 may provide various advantages over the axially extending combustor liners 22 and transition pieces 26 for flowing working fluid therethrough and to the turbine section 16.

As shown, the plurality of transition ducts 50 may be disposed in an annular array about a longitudinal axis 90. Further, each transition duct 50 may extend between a fuel nozzle 40 or plurality of fuel nozzles 40 and the turbine section 16. For example, each transition duct 50 may extend from the fuel nozzles 40 to the turbine section 16. Thus, working fluid may flow generally from the fuel nozzles 40 through the transition duct 50 to the turbine section 16. In some embodiments, the transition ducts 50 may advantageously allow for the elimination of the first stage nozzles in the turbine section, which may eliminate any associated drag and pressure drop and increase the efficiency and output of the system 10.

Each transition duct 50 may have an inlet 52, an outlet 54, and a passage 56 therebetween. The inlet 52 and outlet 54 of a transition duct 50 may have generally circular or oval cross-sections, rectangular cross-sections, triangular cross-sections, or any other suitable polygonal cross-sections. Further, it should be understood that the inlet 52 and outlet 54 of a transition duct 50 need not have similarly shaped cross-sections. For example, in one embodiment, the inlet 52 may have a generally circular cross-section, while the outlet 54 may have a generally rectangular cross-section.

Further, the passage 56 may be generally tapered between the inlet 52 and the outlet 54. For example, in an exemplary embodiment, at least a portion of the passage 56 may be generally conically shaped. Additionally or alternatively, however, the passage 56 or any portion thereof may have a generally rectangular cross-section, triangular cross-section, or any other suitable polygonal cross-section. It should be understood that the cross-sectional shape of the passage 56 may change throughout the passage 56 or any portion thereof as the passage 56 tapers from the relatively larger inlet 52 to the relatively smaller outlet 54.

The outlet 54 of each of the plurality of transition ducts 50 may be offset from the inlet 52 of the respective transition duct 50. The term "offset", as used herein, means spaced from along the identified coordinate direction. The outlet 54 of each of the plurality of transition ducts 50 may be longitudinally offset from the inlet 52 of the respective transition duct 50, such as offset along the longitudinal axis 90.

Additionally, in exemplary embodiments, the outlet 54 of each of the plurality of transition ducts 50 may be tangentially offset from the inlet 52 of the respective transition duct 50, such as offset along a tangential axis 92. Because the outlet 54 of each of the plurality of transition ducts 50 is tangentially offset from the inlet 52 of the respective transition duct 50, the transition ducts 50 may advantageously utilize the tangential component of the flow of working fluid through the transition ducts 50 to eliminate the need for first stage nozzles in the turbine section 16, as discussed below.

Further, in exemplary embodiments, the outlet 54 of each of the plurality of transition ducts 50 may be radially offset from the inlet 52 of the respective transition duct 50, such as offset along a radial axis 94. Because the outlet 54 of each of the plurality of transition ducts 50 is radially offset from the inlet 52 of the respective transition duct 50, the transition ducts 50 may advantageously utilize the radial component of the flow of working fluid through the transition ducts 50 to further eliminate the need for first stage nozzles in the turbine section 16, as discussed below.

Figure 3:
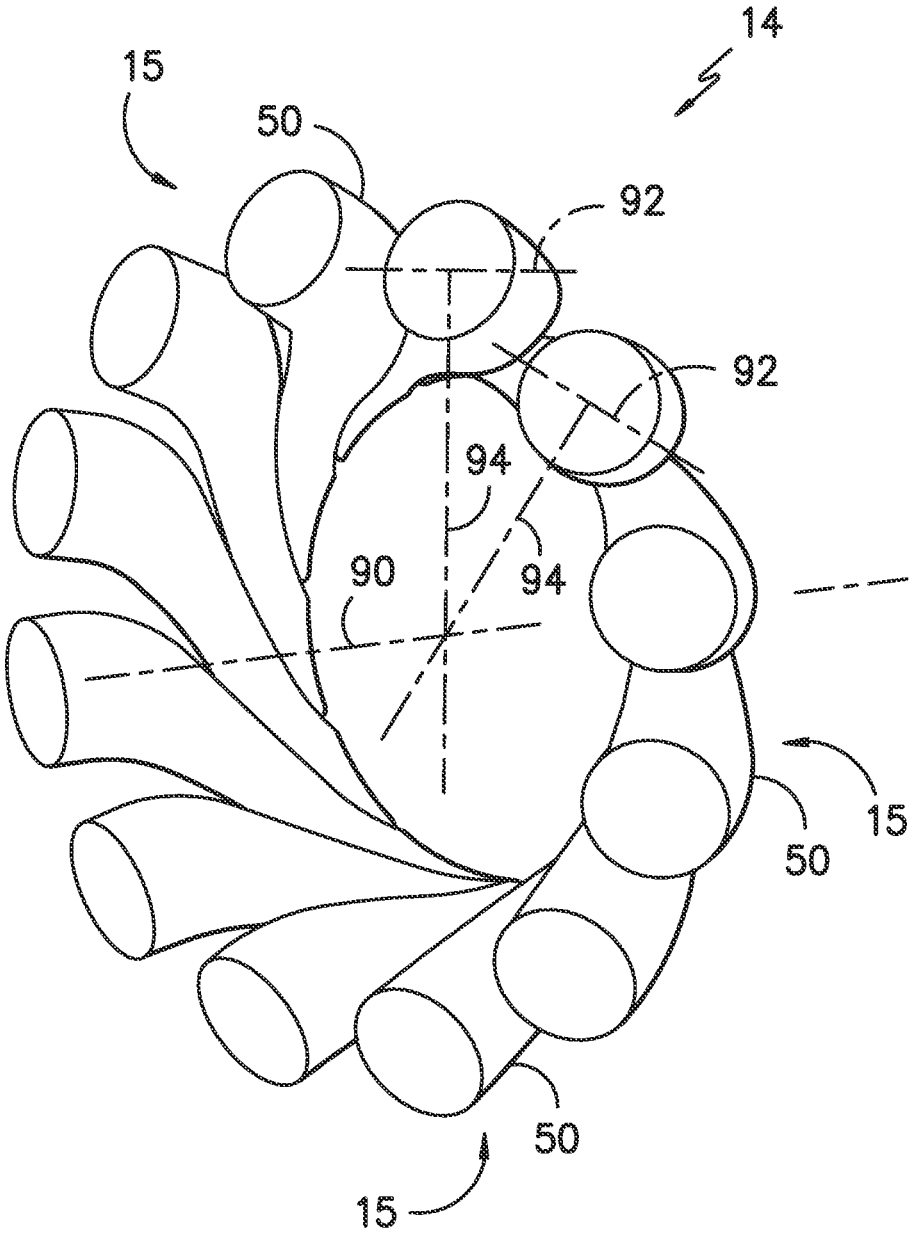
FIG. 3 is a perspective view of an annular array of transition ducts according to one embodiment of the present disclosure.
Figure 4:
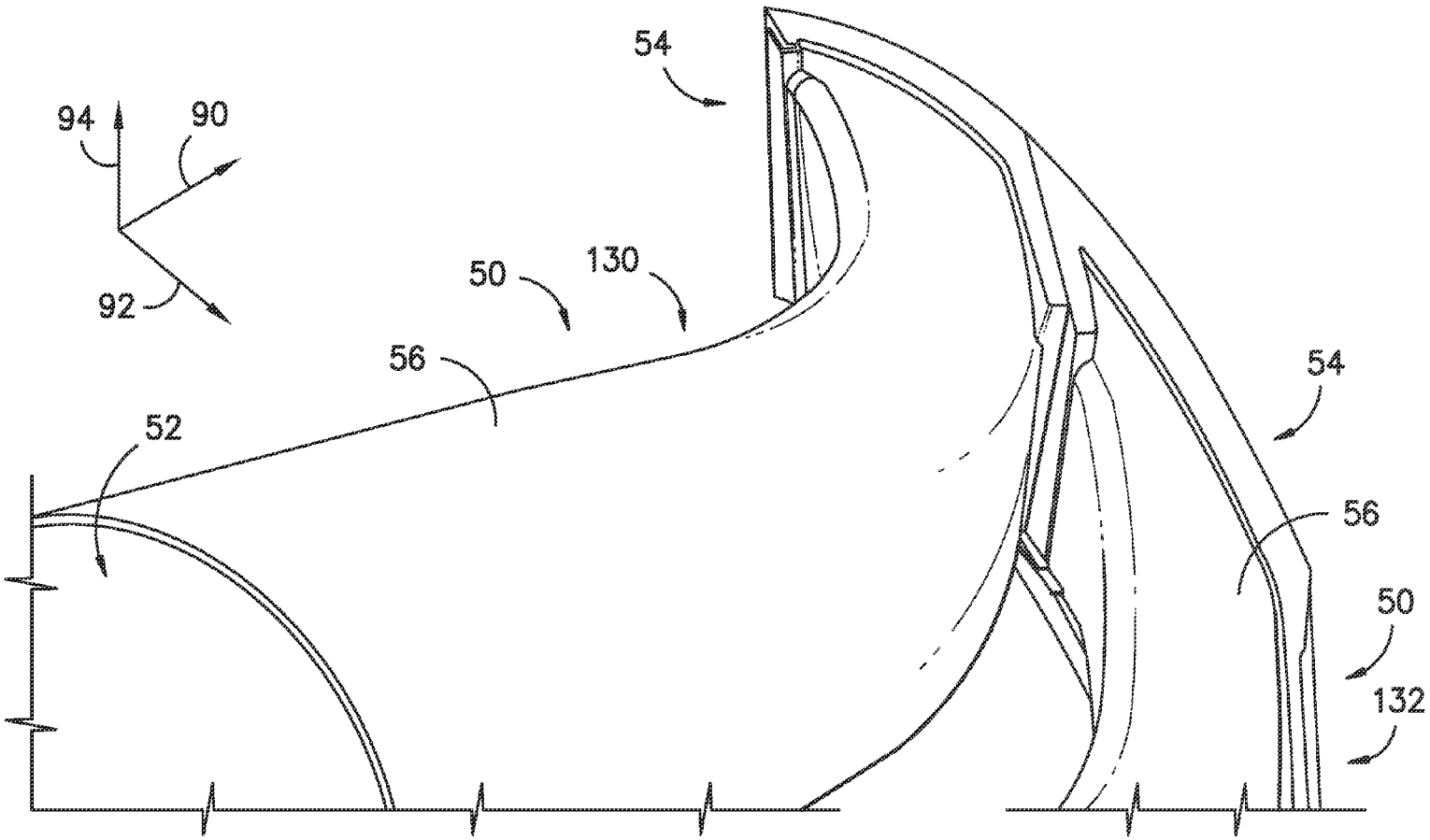
FIG. 4 is a top perspective view of a plurality of transition ducts according to one embodiment of the present disclosure.
Figure 5:
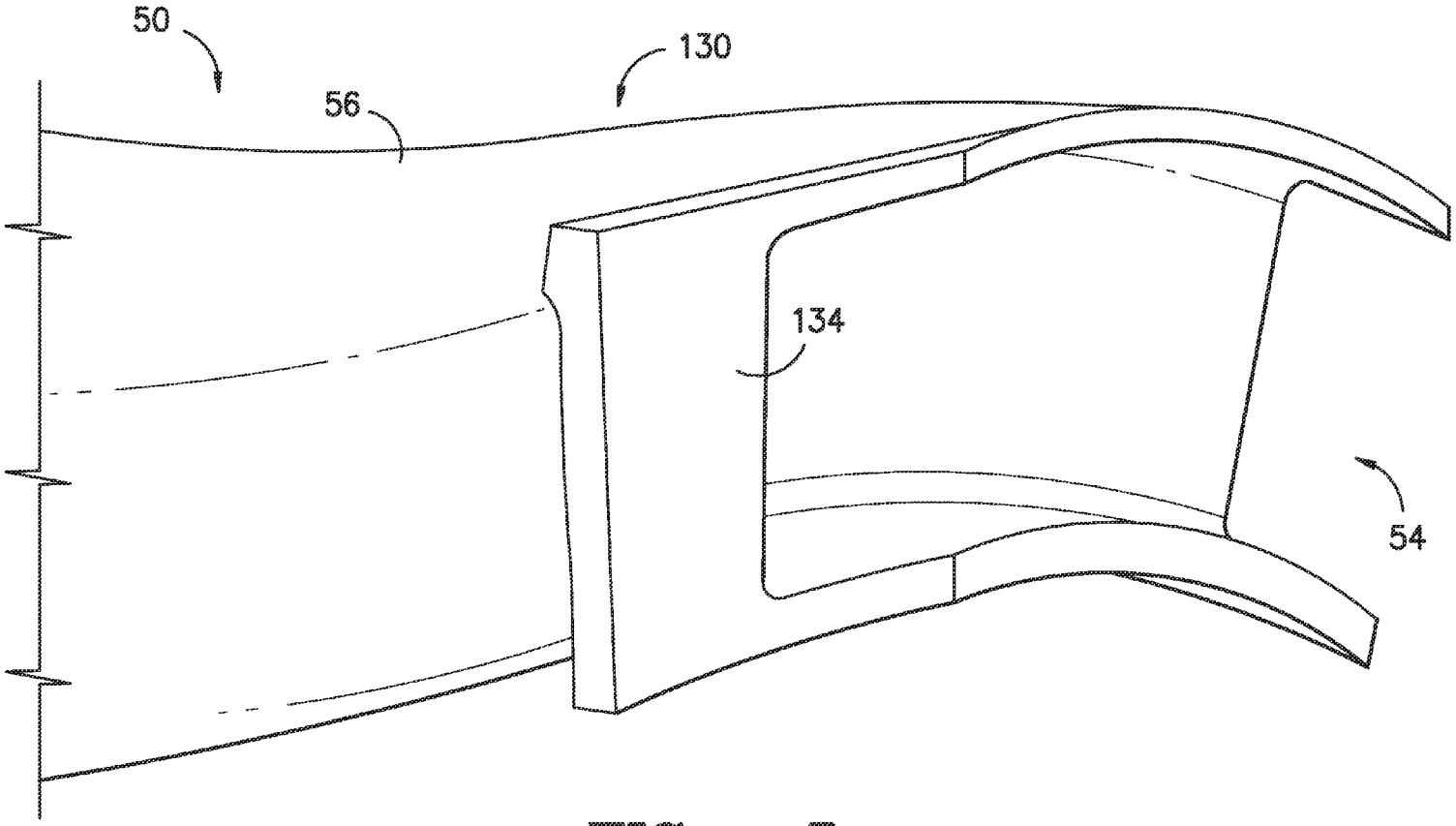
FIG. 5 is a side perspective view of a transition duct according to one embodiment of the present disclosure.

It should be understood that the tangential axis 92 and the radial axis 94 are defined individually for each transition duct 50 with respect to the circumference defined by the annular array of transition ducts 50, as shown in FIG. 3, and that the axes 92 and 94 vary for each transition duct 50 about the circumference based on the number of transition ducts 50 disposed in an annular array about the longitudinal axis 90.

Figure 16:
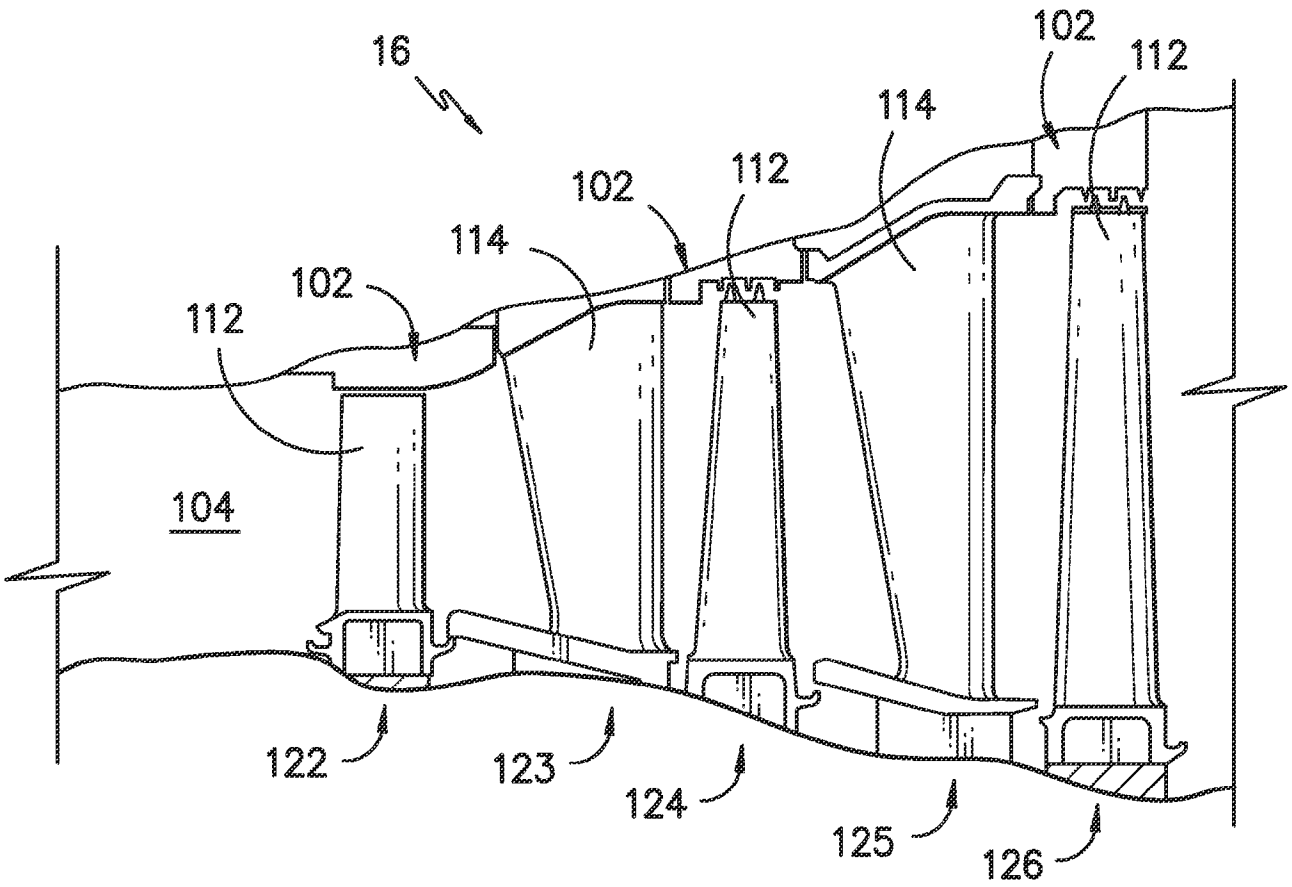
FIG. 16 is a cross-sectional view of a turbine section of a gas turbine system according to one embodiment of the present disclosure.

As discussed, after hot gases of combustion are flowed through the transition duct 50, they may be flowed from the transition duct 50 into the turbine section 16. As shown in FIG. 16, a turbine section 16 according to the present disclosure may include a shroud 102, which may define a hot gas path 104. The shroud 102 may be formed from a plurality of shroud blocks 106. The shroud blocks 106 may be disposed in one or more annular arrays, each of which may define a portion of the hot gas path 104 therein.

The turbine section 16 may further include a plurality of buckets 112 and a plurality of nozzles 114. Each of the plurality of buckets 112 and nozzles 114 may be at least partially disposed in the hot gas path 104. Further, the plurality of buckets 112 and the plurality of nozzles 114 may be disposed in one or more annular arrays, each of which may define a portion of the hot gas path 104.

Figure 13:
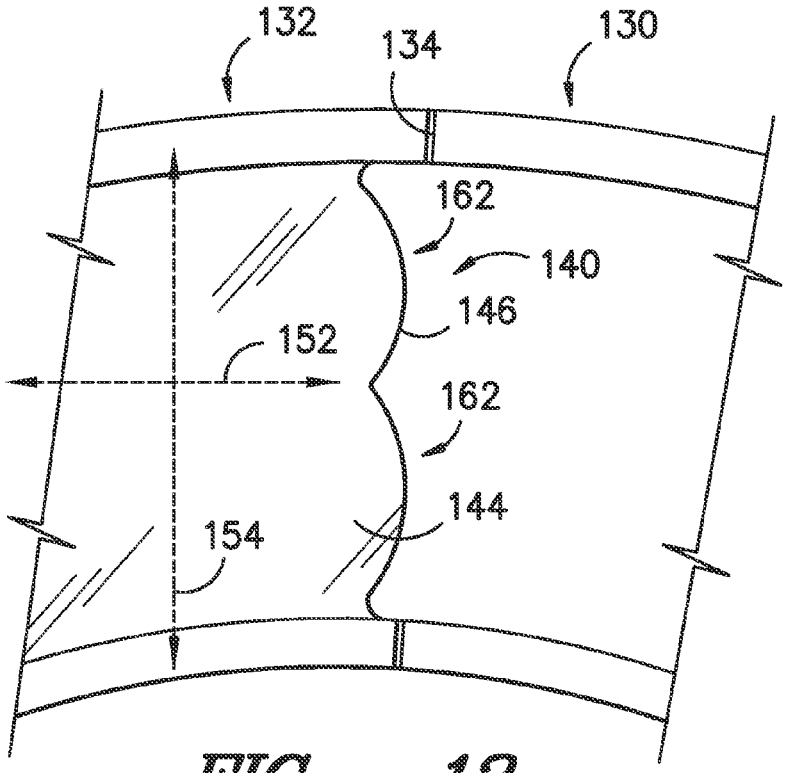
FIG. 13 is a side view of portions of an airfoil, formed by a transition duct assembly comprising neighboring transition ducts, according to another embodiment of the present disclosure.

The turbine section 16 may include a plurality of turbine stages. Each stage may include a plurality of buckets 112 disposed in an annular array and a plurality of nozzles 114 disposed in an annular array. For example, in one embodiment, the turbine section 16 may have three stages, as shown in FIG. 13. For example, a first stage of the turbine section 16 may include a first stage nozzle assembly (not shown) and a first stage buckets assembly 122. The nozzles assembly may include a plurality of nozzles 114 disposed and fixed circumferentially about the shaft 18. The bucket assembly 122 may include a plurality of buckets 112 disposed circumferentially about the shaft 18 and coupled to the shaft 18. In exemplary embodiments wherein the turbine section is coupled to combustor section 14 comprising a plurality of transition ducts 50, however, the first stage nozzle assembly may be eliminated, such that no nozzles are disposed upstream of the first stage bucket assembly 122. Upstream may be defined relative to the flow of hot gases of combustion through the hot gas path 104.

A second stage of the turbine section 16 may include a second stage nozzle assembly 123 and a second stage buckets assembly 124. The nozzles 114 included in the nozzle assembly 123 may be disposed and fixed circumferentially about the shaft 18. The buckets 112 included in the bucket assembly 124 may be disposed circumferentially about the shaft 18 and coupled to the shaft 18. The second stage nozzle assembly 123 is thus positioned between the first stage bucket assembly 122 and second stage bucket assembly 124 along the hot gas path 104. A third stage of the turbine section 16 may include a third stage nozzle assembly 125 and a third stage bucket assembly 126. The nozzles 114 included in the nozzle assembly 125 may be disposed and fixed circumferentially about the shaft 18. The buckets 112 included in the bucket assembly 126 may be disposed circumferentially about the shaft 18 and coupled to the shaft 18. The third stage nozzle assembly 125 is thus positioned between the second stage bucket assembly 124 and third stage bucket assembly 126 along the hot gas path 104.

It should be understood that the turbine section 16 is not limited to three stages, but rather that any number of stages are within the scope and spirit of the present disclosure.

Each transition duct 50 may interface with one or more adjacent transition ducts 50. For example, FIGS. 4 through 12 illustrate a first transition duct 130 and a second transition duct 132 of the plurality of transition ducts 50. These neighboring transition ducts 130, 132 may include contact faces 134, which may be outer surfaces included in the outlets of the transition duct 50. The contact faces 134 may contact associated contact faces 134 of adjacent neighboring transition ducts 50, as shown, to provide an interface between the transition ducts 50. For example, contact faces 134 of the first and second transition ducts 130, 132 may, as shown, contact each other and provide an interface between the first and second transition ducts 130, 132.

Figure 6:
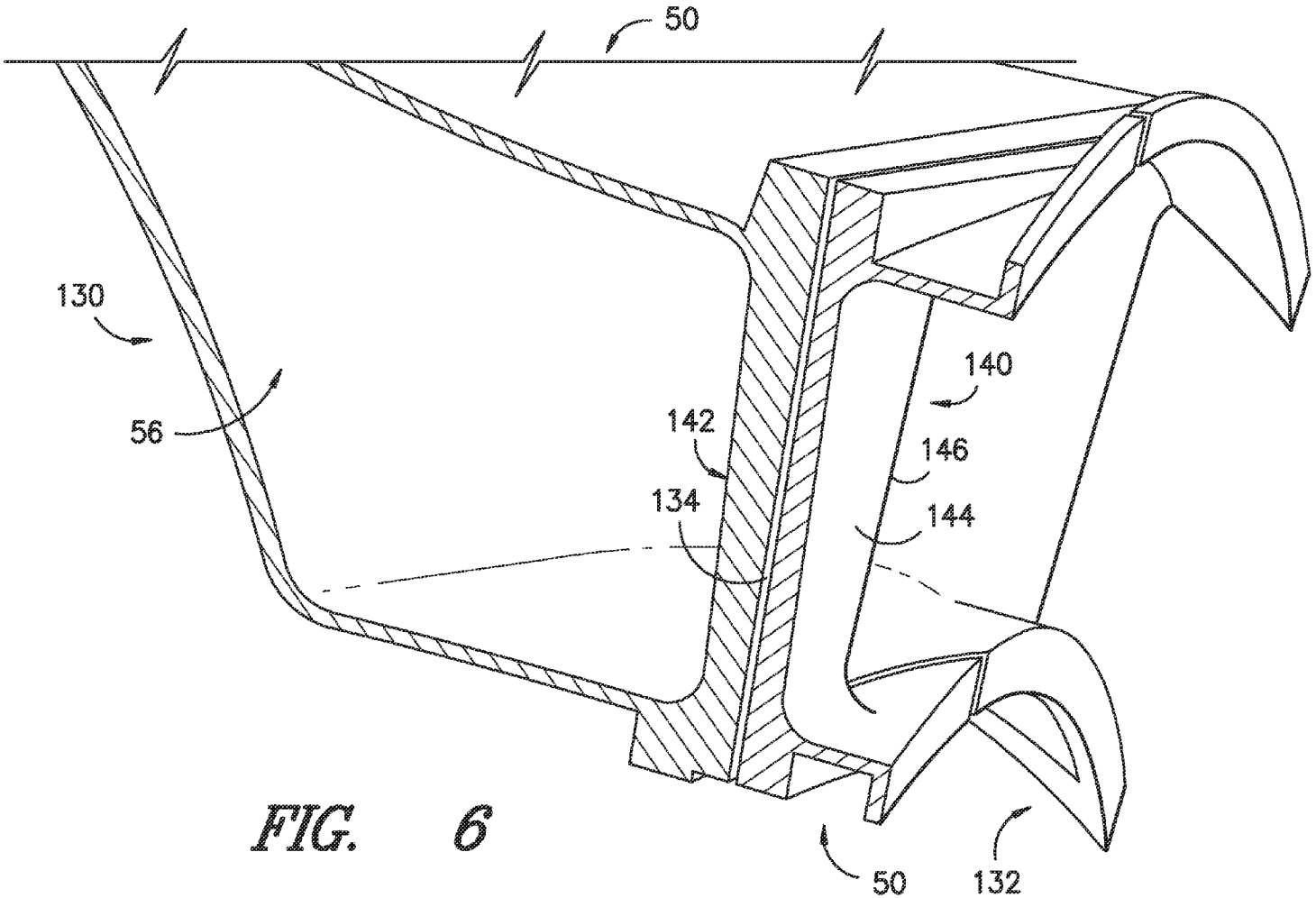
FIG. 6 is a cutaway perspective view of a transition duct assembly, comprising neighboring transition ducts and forming various portions of an airfoil therebetween according to one embodiment of the present disclosure.
Figure 7:
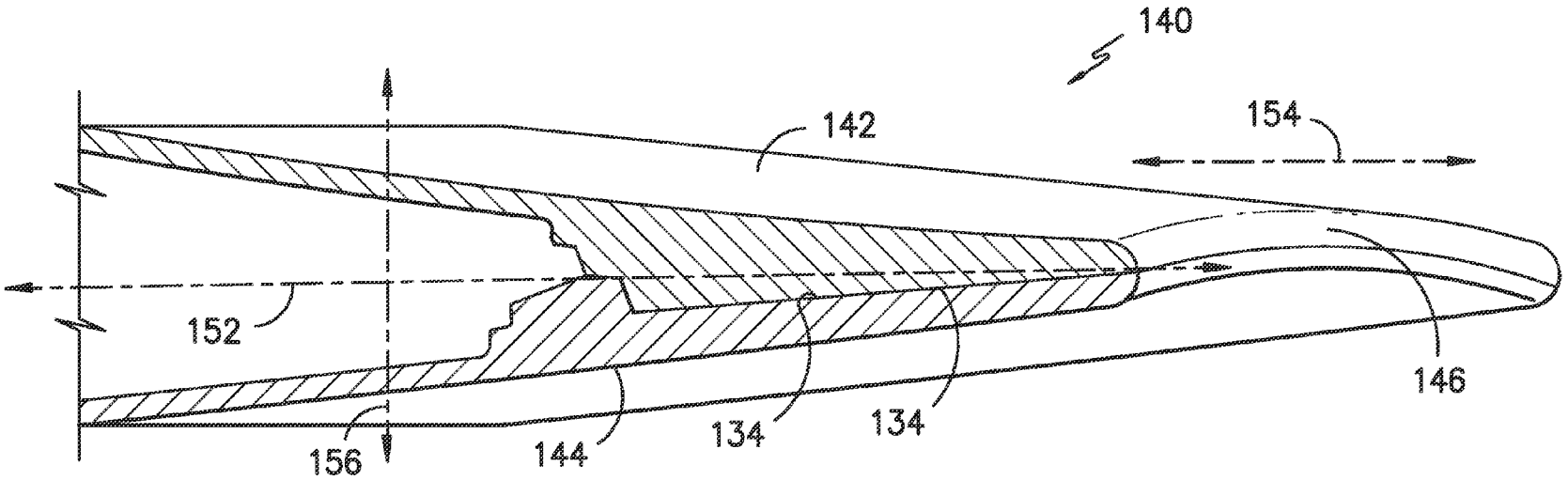
FIG. 7 is a cross-sectional view of portions of an airfoil, formed by a transition duct assembly comprising neighboring transition ducts, according to one embodiment of the present disclosure.
Figure 8:
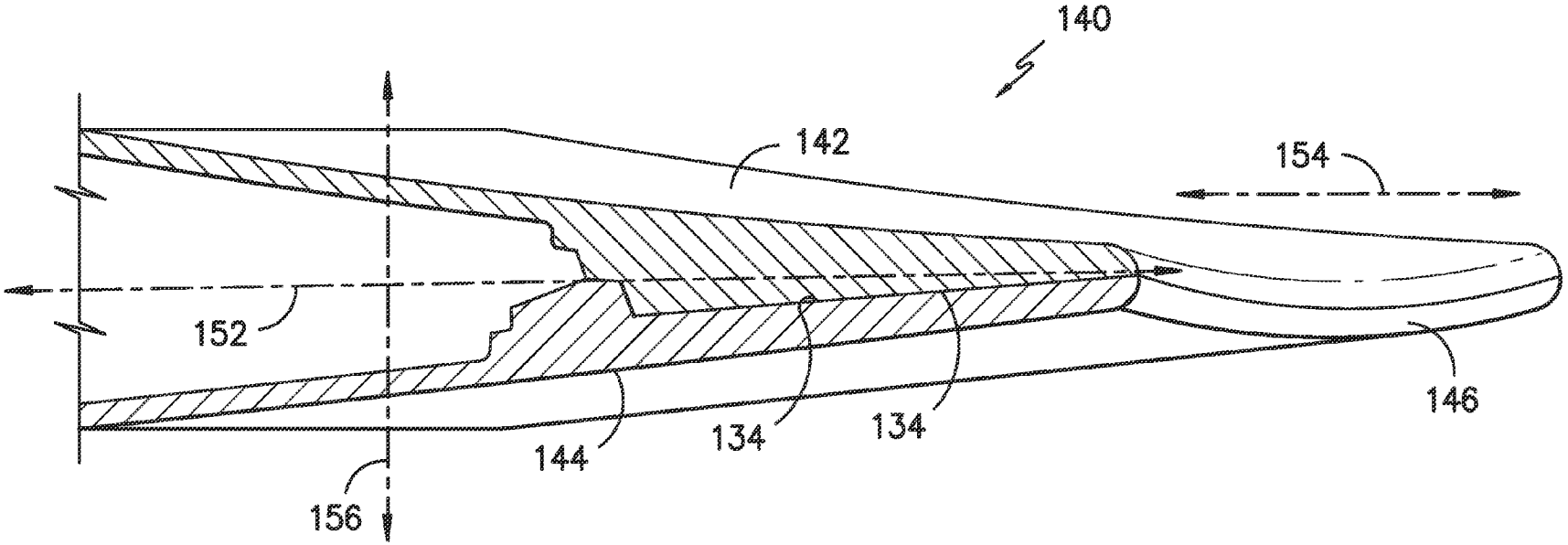
FIG. 8 is a cross-sectional view of portions of an airfoil, formed by a transition duct assembly comprising neighboring transition ducts, according to another embodiment of the present disclosure.
Figure 9:
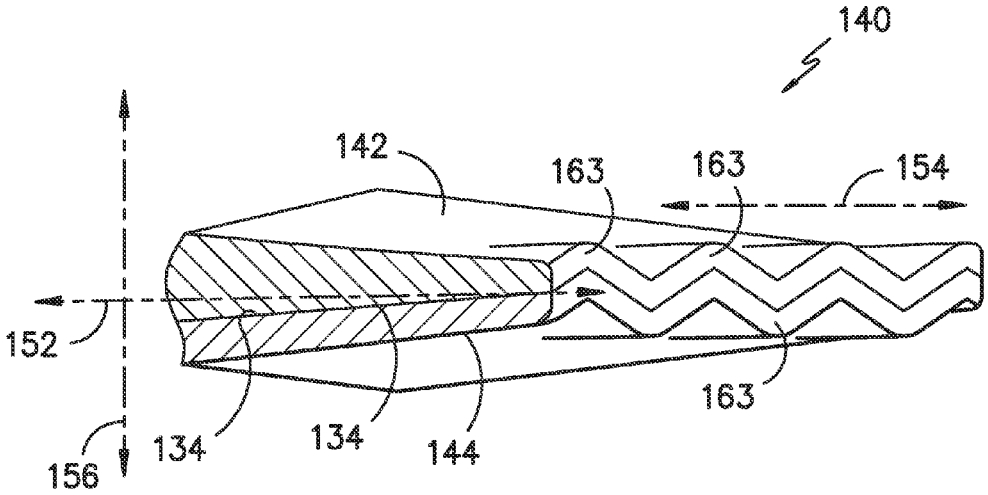
FIG. 9 is a cross-sectional view of portions of an airfoil, formed by a transition duct assembly comprising neighboring transition ducts, according to another embodiment of the present disclosure.

Further, the adjacent transition ducts 50, such as the first and second transition ducts 130, 132, may combine to form aerodynamic structures 140 therebetween having various aerodynamic surface of an airfoil. Such aerodynamic structure 140 may, for example, be defined by inner surfaces of the passages 56 of the transition ducts 50, and further may be formed when the contact surfaces 134 of adjacent transition ducts 50 interface with each other. These various surfaces may shift the hot gas flow in the transition ducts 50, and thus eliminate the need for first stage nozzles, as discussed above. For example, as shown in FIGS. 6 through 8, an inner surface of a passage 56 of a transition duct 50, such as a first transition duct 130, may define a pressure side 142, while an opposing inner surface of a passage 56 of an adjacent transition duct 50, such as a second transition duct 132, may define a suction side 144. When the adjacent transition ducts 50, such as the contact faces 134 thereof, interface with each other, the pressure side 142 and suction side 144 may combine to define a trailing edge 146.

Referring now to FIGS. 7 through 15, an aerodynamic structure 140 according to the present disclosure includes a trailing edge 146 that has a modified aerodynamic contour. The modified aerodynamic contour may, in exemplary embodiments, increase the efficiency of the transition ducts 50 and turbomachine in general by, for example, reducing aerodynamic losses and further reducing wakes during operation. Further, such modified aerodynamic contour may generate substantially uniform velocities and temperature fields impacting the stage one bucket assemblies. Thus, the stage one bucket assemblies advantageously experience reduced high cycle fatigue loads and thermal loads. Such flow conditions may thus improve the durability of the stage one bucket assemblies.

Figure 10:
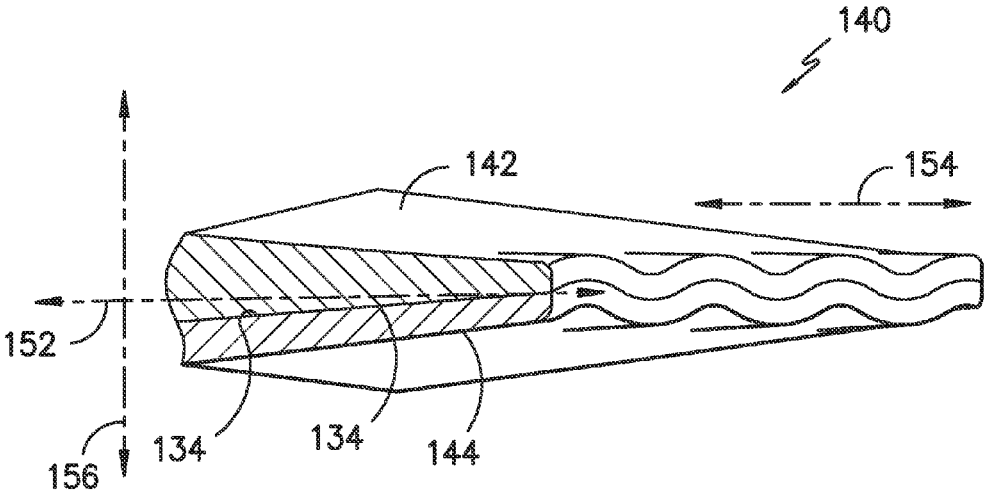
FIG. 10 is a cross-sectional view of portions of an airfoil, formed by a transition duct assembly comprising neighboring transition ducts, according to another embodiment of the present disclosure.

A trailing edge 146 may have a modified aerodynamic contour through modification of the shape of the trailing edge 146 and/or orientation of the trailing edge 146. For example, FIGS. 7 through 10 illustrate various embodiments of trailing edges 146 having modified aerodynamic contours according to exemplary embodiments of the present disclosure. As shown, an aerodynamic structure 140 according to the present disclosure defines a chord-wise axis 152, a span-wise axis 154, and a yaw axis 156. Each axis 152, 154, 156 is generally perpendicular to the other axes, as shown, such that for example, the yaw axis 156 is perpendicular to the chord-wise axis 152 and the span-wise axis 154. FIGS. 7 and 8 illustrate views of an aerodynamic structure 140, with a plane defined by the span-wise axis 154 and the yaw axis 156. The trailing edge 146, or at least a portion thereof, may be curvilinear or chevron-shaped in this plane, as shown. For example, in some embodiments the trailing edge 146 may be curved towards the pressure side 142, as shown in FIG. 7, while in other embodiments, the trailing edge 146 may be curved towards the suction side 144, as shown in FIG. 8. Further, while FIGS. 7 and 8 illustrate trailing edges 146 having single curvilinear sections, in other embodiments as illustrated in FIG. 10, a trailing edge 146 may include a plurality of curvilinear sections. Each section may have an independent curve, which may be curved towards the pressure side 142 or suction side 144. Two, three, four or more curvilinear sections may be provided. Thus, the trailing edge 146 may be have a curvilinear pattern which alternates curves towards the pressure side 142 and suction side 144. Alternatively, referring to FIG. 9, the trailing edge 146 may comprises a plurality of chevrons 163, such that a sawtooth pattern is generally provided through the trailing edge 146 or a portion thereof in the plane defined by the span-wise axis 154 and yaw axis 156. Alternatively, bristles or other suitably shaped features may be provided on the trailing edge 146 and extend in the plane to cause turbulent flow similar to the operation of the chevrons 163.

Figure 11:
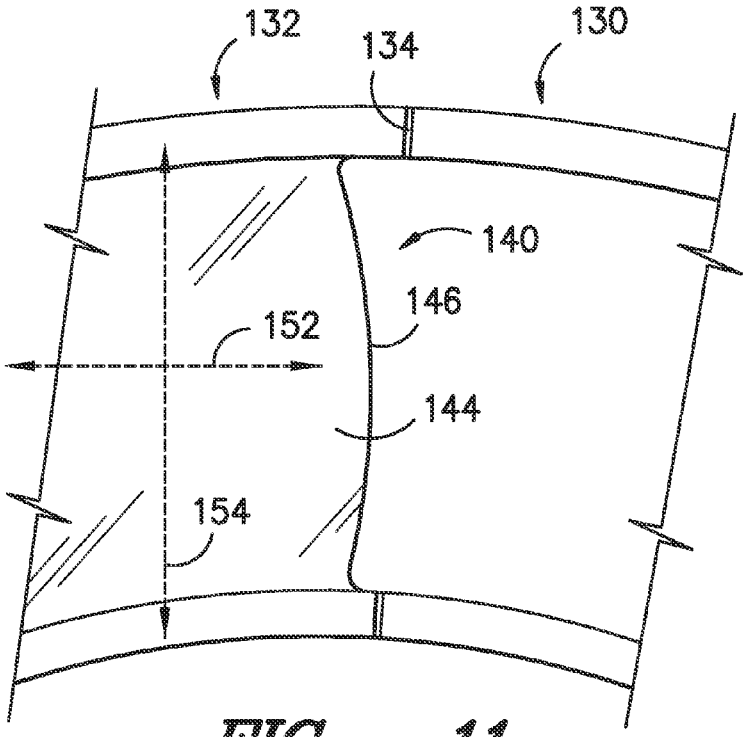
FIG. 11 is a side view of portions of an airfoil, formed by a transition duct assembly comprising neighboring transition ducts, according to one embodiment of the present disclosure.
Figure 12:
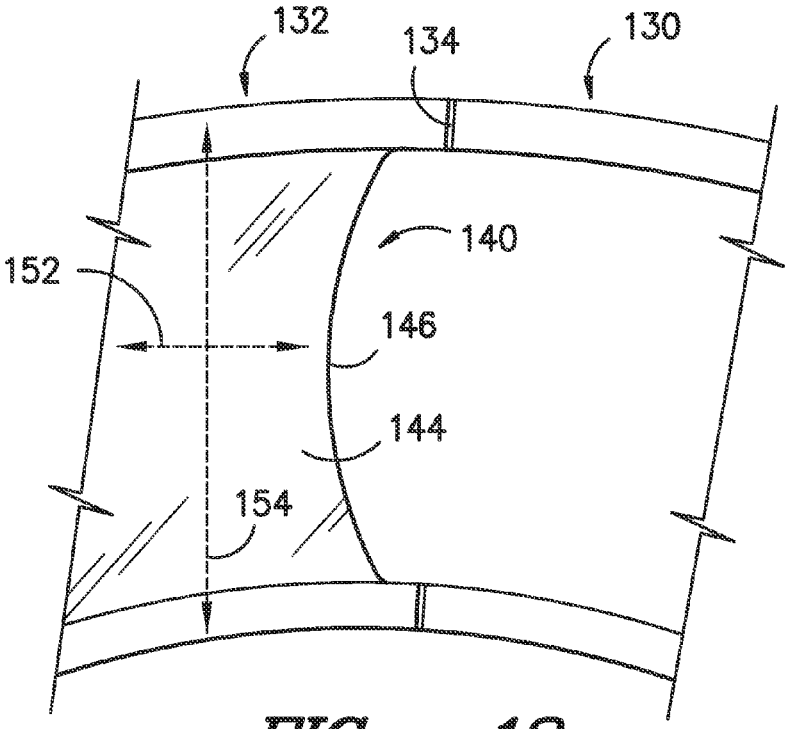
FIG. 12 is a side view of portions of an airfoil, formed by a transition duct assembly comprising neighboring transition ducts, according to another embodiment of the present disclosure.

FIGS. 11 through 13 illustrate various further embodiments of an aerodynamic structure 140 with a trailing edge 146 having a modified aerodynamic contour. For example, FIGS. 11 through 13 illustrate views of an aerodynamic structure 140 in a plane defined by the chord-wise axis 152 and the span-wise axis 154. The trailing edge 146, or at least a portion thereof, may be curvilinear in this plane, as shown. For example, in some embodiments as shown in FIG. 12, the trailing edge 146 may have a convex curvilinear shape. In other embodiments, as shown in FIG. 11, the trailing edge 146 may have a concave curvilinear shape. Further, while FIGS. 11 and 12 illustrate trailing edges 146 having single curvilinear sections, in other embodiments as shown in FIG. 13, a trailing edge 146 may include a plurality of curvilinear sections 162. Each section 162 may have an independent curve, which may be convex as shown or concave. Two, three, four or more curvilinear sections 162 may be provided.

Figure 14:
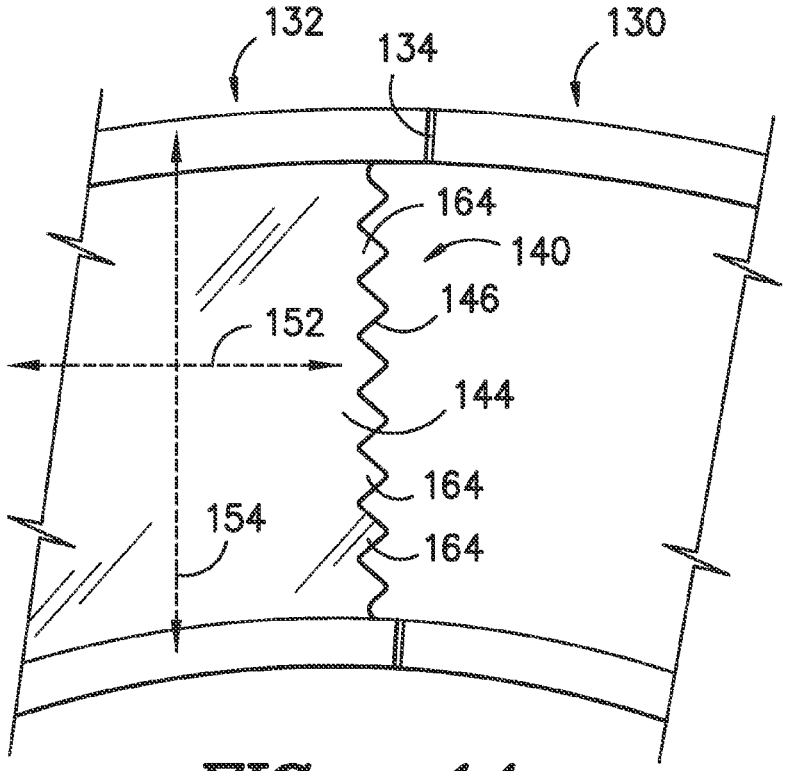
FIG. 14 is a side view of portions of an airfoil, formed by a transition duct assembly comprising neighboring transition ducts, according to another embodiment of the present disclosure.

FIG. 14 illustrates a further embodiment of an aerodynamic structure 140 with a trailing edge 146 having a modified aerodynamic contour in the plane defined by the chord-wise axis 152 and the span-wise axis 154. In these embodiments, the trailing edge 146 comprises a plurality of chevrons 164, such that a sawtooth pattern is generally provided through the trailing edge 146 or a portion thereof in the plane defined by the chord-wise axis 152 and the span-wise axis 154. Alternatively, bristles or other suitably shaped features may be provided on the trailing edge 146 and extend in the plane to cause turbulent flow similar to the operation of the chevrons 164.

Figure 15:
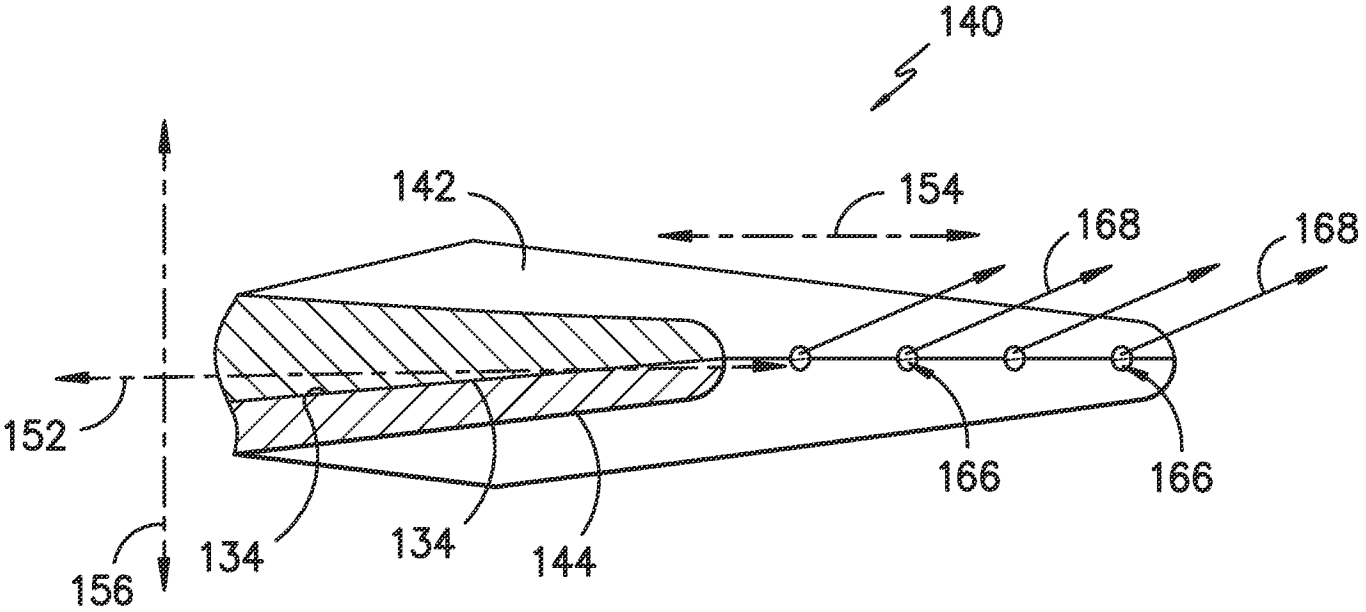
FIG. 15 is a cross-sectional view of portions of an airfoil, formed by a transition duct assembly comprising neighboring transition ducts, according to another embodiment of the present disclosure.

FIG. 15 illustrates a further embodiment of an aerodynamic structure 140 with a trailing edge 146 having a modified aerodynamic contour. In these embodiments, one or more channels 166 may be defined in the trailing edge 146, such as between portions of the contact faces 134. Jets of suitable gases 168, such as portions of the combustion gases, cooling gases, etc., may be flowed through channels 166 and exhausted at the trailing edge 146. Thus, fluidics mixing may be facilitated by the channels 166 and the exhaust gases 168 therefrom. The channels 166 may positioned such that gases 168 are exhausted generally along the chord-wise axis 152, or at a suitable angle, such as an angle to the chord-wise axis 152 in the plane defined by the chord-wise axis 152 and the yaw axis 156 and/or the plane defined by the chord-wise axis 152 and the span-wise axis 154.

Accordingly, transition duct assemblies comprising a plurality of transition ducts 50 defining aerodynamic structures 140 therebetween according to the present disclosure beneficially experience increased efficiency during turbomachine operation. For example, the use of aerodynamic structures 140 which include trailing edges 146 that have modified aerodynamic contours as discussed herein may increase the efficiency of the transition ducts 50 and turbomachine in general by, for example, reducing aerodynamic losses and further reducing wakes during operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A transition duct assembly for a turbine system, the transition duct assembly comprising:

a plurality of transition ducts disposed in a generally annular array and comprising a first transition duct and a second transition duct, each of the plurality of transition ducts comprising a radially inner wall portion, a radially outer wall portion, a radially extending side wall portion coupled to and extending between the radially inner wall portion and the radially outer wall portion, an inlet, an outlet, and a passage extending between the inlet and the outlet and defining a longitudinal axis, a radial axis, and a tangential axis, the outlet of each of the plurality of transition ducts offset from the corresponding inlet of each of the plurality of transition ducts along the corresponding longitudinal and tangential axes of each of the plurality of transition ducts, wherein each of the plurality of transition ducts directs combustion gases at least partially along the corresponding tangential axis of each of the plurality of transition ducts; and an aerodynamic structure partially formed by adjacent radially extending side wall portions of the first transition duct and the second transition duct, the aerodynamic structure comprising a pressure side, a suction side, and a trailing edge and defining a chord-wise axis extending from an inlet side of the aerodynamic structure to an outlet side of the aerodynamic structure, a span-wise axis perpendicular to the chord-wise axis and extending between the radially inner wall portions of the first and second transition ducts and the radially outer wall portions of the first and second transition ducts, and a yaw axis perpendicular to the chord-wise axis and the span-wise axis and extending between the pressure side and the suction side, wherein the trailing edge comprises a lobe extending from the radially inner wall portions of the first and second transition ducts to the radially outer wall portions of the first and second transition ducts, the lobe being entirely curvilinear in a plane defined by the chord-wise axis and the span-wise axis.

2. The transition duct assembly of claim 1, wherein the lobe is convex.

3. The transition duct assembly of claim 1, wherein the lobe is concave.

4. The transition duct assembly of claim 1, wherein the outlet of each of the plurality of transition ducts is further offset from the inlet of each of the plurality of transition ducts along the corresponding radial axis of each of the plurality of transition ducts.

5. A turbomachine, comprising:

an inlet section;

an exhaust section;

a compressor section;

a turbine section; and a combustor section between the compressor section and the turbine section, the combustor section comprising:

a plurality of transition ducts disposed in a generally annular array and comprising a first transition duct and a second transition duct, each of the plurality of transition ducts comprising a radially inner wall portion, a radially outer wall portion, a radially extending side wall portion coupled to and extending between the radially inner wall portion and the radially outer wall portion, an inlet, an outlet, and a passage extending between the inlet and the outlet and defining a longitudinal axis, a radial axis, and a tangential axis, the outlet of each of the plurality of transition ducts offset from the corresponding inlet of each of the plurality of transition ducts along the corresponding longitudinal and tangential axes of each of the plurality of transition ducts, wherein each of the plurality of transition ducts directs combustion gases at least partially along the corresponding tangential axis of each of the plurality of transition ducts; and an aerodynamic structure partially formed by adjacent radially extending side wall portions of the first transition duct and the second transition duct, the aerodynamic structure comprising a pressure side, a suction side, and a trailing edge and defining a chord-wise axis extending from an inlet side of the aerodynamic structure to an outlet side of the aerodynamic structure, a span-wise axis perpendicular to the chord-wise axis and extending between the radially inner wall portions of the first and second transition ducts and the radially outer wall portions of the first and second transition ducts, and a yaw axis perpendicular to the chord-wise axis and the span-wise axis and extending between the pressure side and the suction side, wherein the trailing edge comprises a lobe extending from the radially inner wall portions of the first and second transition ducts to the radially outer wall portions of the first and second transition ducts, the lobe being entirely curvilinear in a plane defined by the chord-wise axis and the span-wise axis.

6. The turbomachine of claim 5, wherein the turbine section comprises a first stage bucket assembly, and wherein no first stage nozzles are disposed upstream of the first stage bucket assembly in the turbine section.

7. The turbomachine of claim 5, wherein the lobe is convex.

8. The turbomachine of claim 5, wherein the lobe is concave.

9. The turbomachine of claim 5, wherein the outlet of each of the plurality of transition ducts is further offset from the inlet of each of the plurality of transition ducts along the corresponding radial axis of each of the plurality of transition ducts.

* * * * *